US010173416B2

(12) United States Patent
Sasaki et al.

(10) Patent No.: US 10,173,416 B2
(45) Date of Patent: Jan. 8, 2019

(54) DROPLET DISCHARGE APPARATUS, CONTROL DEVICE, AND CONTROL METHOD

(71) Applicant: SEIKO EPSON CORPORATION, Tokyo (JP)

(72) Inventors: Tsuneyuki Sasaki, Matsumoto (JP); Katsuya Asamoto, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/665,067

(22) Filed: Jul. 31, 2017

(65) Prior Publication Data

US 2018/0037022 A1 Feb. 8, 2018

(30) Foreign Application Priority Data

Aug. 4, 2016 (JP) ..... 2016-153407

(51) Int. Cl.
*B41J 2/045* (2006.01)
*B41J 2/14* (2006.01)

(52) U.S. Cl.
CPC ..... *B41J 2/04508* (2013.01); *B41J 2/0451* (2013.01); *B41J 2/04535* (2013.01); *B41J 2/04536* (2013.01); *B41J 2/04551* (2013.01); *B41J 2/04553* (2013.01); *B41J 2/04566* (2013.01); *B41J 2/04581* (2013.01); *B41J 2/04586* (2013.01); *B41J 2002/14354* (2013.01)

(58) Field of Classification Search
CPC ... B41J 2/04535; B41J 2/0451; B41J 2/16517
See application file for complete search history.

(56) References Cited

U.S. PATENT DOCUMENTS 6,299,277 B1 10/2001 Fujii
2005/0190389 A1* 9/2005 Tanaka ..... H04N 1/6033 358/1.9
2006/0290739 A1* 12/2006 Hatayama ..... B41J 2/16517 347/35

FOREIGN PATENT DOCUMENTS

| | | |
|---|---|---|
| JP | 10-146993 | 6/1998 |
| JP | 2002-292837 | 10/2002 |
| JP | 2008-119980 | 5/2008 |
| JP | 5191417 | 2/2013 |
| JP | 2013-103442 | 5/2013 |
| JP | 2015-147340 | 8/2015 |
| JP | 2016-007773 | 1/2016 |
| JP | 2016-030385 | 3/2016 |

* cited by examiner

*Primary Examiner* — Kristal Feggins
*Assistant Examiner* — Kendrick Liu
(74) *Attorney, Agent, or Firm* — Workman Nydegger

(57) ABSTRACT

A printing apparatus (droplet discharge apparatus) includes a discharge portion that has a nozzle discharging ink to a medium and a control device that allows the discharge portion to discharge the ink depending on execution of a print job defining a mode for discharging the ink to the medium. Before the print job is executed, the control device calculates a discharge amount fluctuation which is a fluctuation in a discharge amount of liquid per unit time by the discharge portion based on the print job and determines whether or not maintenance for recovering ink discharge performance of the discharge portion is required at the time of executing the print job based on the discharge amount fluctuation.

8 Claims, 6 Drawing Sheets

DROPLET DISCHARGE APPARATUS, CONTROL DEVICE, AND CONTROL METHOD

BACKGROUND

1. Technical Field

The present invention relates to a droplet discharge apparatus such as an ink jet printer, and a control device and a control method of the droplet discharge apparatus.

2. Related Art

To date, as examples of a droplet discharge apparatus, there are known image forming apparatuses that perform printing by discharging ink from a recording head (discharge portion) to a medium such as paper. In such image forming apparatuses, some image forming apparatuses execute maintenance of the recording head when a measured value such as the number of printed sheets or the amount of discharged ink exceeds a predetermined threshold value (for example, JP-A-2013-103442).

However, in the image forming apparatus as described above, since the maintenance starts at a time when the measured value such as the number of printed sheets or the amount of discharged ink, which increases as printing continues, exceeds the threshold value, the printing may be interrupted at a time that is not expected by a user of the image forming apparatus. Therefore, when execution conditions for maintenance are satisfied during execution of one print job, printing quality may be lowered due to the interruption of the printing. For example, degradation of the printing quality may be caused since printing unevenness (banding) occurs on a boundary between an image printed before the maintenance and an image printed after the maintenance.

The above-described disadvantages are substantially common to a droplet discharge apparatus that executes maintenance of the discharge portion discharging droplets to a medium based on a droplet discharge job as well as a printing apparatus that performs printing by discharging ink to a medium based on a print job.

SUMMARY

An advantage of some aspects of the invention is to provide a droplet discharge apparatus that suppresses maintenance of a discharge portion, which is not expected by the user, from being executed while discharging droplets from the discharge portion toward a medium based on a droplet discharge job, and to provide a control device and a control method of the droplet discharge apparatus.

Some aspects of the invention and operations and advantages thereof will be described below.

A droplet discharge apparatus according to an aspect of the invention includes a discharge portion that has a nozzle discharging droplets to a medium, and a control device that allows the discharge portion to discharge the droplets depending on an execution of a droplet discharge job defining a mode for discharging the droplets to the medium, in which before the droplet discharge job is executed, the control device calculates a discharge amount fluctuation, which is a fluctuation in a discharge amount of liquid per unit time by the discharge portion, based on the droplet discharge job and determines whether or not maintenance for recovering droplet discharge performance of the discharge portion is required at the time of executing the droplet discharge job based on the discharge amount fluctuation.

An example of variables affecting drying of the nozzle of the discharge portion includes humidity in the ambient of the nozzle (hereinafter referred to as "nozzle ambient humidity"). When the nozzle ambient humidity is high, the nozzle is not easily dried, but when the nozzle ambient humidity is low, the nozzle is easily dried. In addition, when a discharge amount of the droplets per unit time is large at the time of executing the droplet discharge job, an evaporation amount of the droplets discharged to the medium is increased and the nozzle ambient humidity thus tends to be high, but when the discharge amount of the droplets is small, the evaporation amount of the droplets discharged to the medium is decreased and the nozzle ambient humidity thus tends to be low.

According to the above configuration, the control device calculates the discharge amount fluctuation based on the droplet discharge job, and determines whether or not the maintenance is required during the execution of the droplet discharge job based on the discharge amount fluctuation. That is, the control device estimates a dried state of the nozzle based on the discharge amount fluctuation, and determines whether or not the maintenance is required when the droplet discharge job is actually executed.

In this way, when it is determined that the maintenance is required at the time of executing the droplet discharge job, it is possible to notify a user of such a fact before the droplet discharge job is executed. Accordingly, it is possible to suppress the maintenance which is not expected by the user, from being executed at the time of executing the droplet discharge job.

In the droplet discharge apparatus, it is preferable that when the humidity in the vicinity of the nozzle is the nozzle ambient humidity and the nozzle ambient humidity is used as a reference humidity serving as a threshold value that indicates whether drying of the nozzle is progressed, before the droplet discharge job is executed, the control device calculate a humidity fluctuation which is a fluctuation in the nozzle ambient humidity per unit time based on the discharge amount fluctuation, and determines that the maintenance is required at the time of executing the droplet discharge job when a state in which the nozzle ambient humidity per unit time is lower than the reference humidity continues in the humidity fluctuation.

According to the above configuration, since it is determined whether or not the maintenance is required by comparing the nozzle ambient humidity per unit time with the reference humidity in the humidity fluctuation, it is possible to easily perform the determination.

In the droplet discharge apparatus, it is preferable that the control device calculate the humidity fluctuation based on a nozzle ambient temperature which is a temperature in the vicinity of the nozzle.

Even when the discharge amount of the droplets is uniform, the evaporation amount of the droplets discharged to the medium may be increased when the nozzle ambient temperature is high, whereas the evaporation amount of the droplets discharged to the medium may be decreased when the nozzle ambient temperature is low. That is, even when the discharge amount of the droplets is uniform, the nozzle ambient humidity may be changed depending on the nozzle ambient temperature. In this aspect, according to the above configuration, it is determined whether or not the maintenance is required at the time of executing the droplet discharge job based on the humidity fluctuation that is calculated based on the nozzle ambient temperature. Therefore, it is possible to increase the precision of determination of whether or not the maintenance is required.

It is preferable that the droplet discharge apparatus include a temperature detection portion that detects the nozzle ambient temperature and the control device acquire the nozzle ambient temperature based on a detection result of the temperature detection portion.

According to the above configuration, since the nozzle ambient humidity can be calculated based on the nozzle ambient temperature actually measured by the temperature detection portion, it is possible to calculate the humidity fluctuation with high precision. Accordingly, it is possible to increase the precision of determination of whether or not the maintenance is required at the time of executing the droplet discharge job.

It is preferable that the droplet discharge apparatus have a heating portion that heats the medium to which the droplets are discharged and the control device acquire the nozzle ambient temperature based on a driving mode of the heating portion.

When the heating portion is strongly driven, the nozzle ambient temperature becomes high, whereas when the heating portion is weakly driven, the nozzle ambient temperature becomes low. In this aspect, according to the above configuration, since the nozzle ambient temperature is calculated based on the driving mode of the heating portion, there is no need to provide a component for detecting the nozzle ambient temperature. Therefore, it is possible to simplify a configuration of the droplet discharge apparatus.

It is preferable that the droplet discharge apparatus include a housing that houses the discharge portion and a ventilation portion that ventilates an inside of the housing by taking outside air into the housing, and the control device calculate the humidity fluctuation based on outside air humidity which is humidity of the outside air.

According to the above configuration, since the inside of the housing can be ventilated by taking the outside air into the housing, it is possible to suppress dew condensation from occurring due to an increase in the nozzle ambient humidity. In addition, when the inside of the housing is ventilated, since the outside air humidity of the outside air taken in for ventilation affects the nozzle ambient humidity, it is possible to suppress the precision of calculation of the humidity fluctuation from being decreased by calculating the humidity fluctuation based on the outside air humidity.

In the droplet discharge apparatus, it is preferable that the ventilation portion include a take-in channel that takes the outside air into the housing and a humidity detection portion that detects the outside air humidity, and the humidity detection portion be provided in the take-in channel.

When the humidity detection portion is disposed inside the housing, foreign matter such as liquid mist or dust adheres to the humidity detection portion and decreases the precision of detection of the outside air humidity. In this aspect, according to the above configuration, since the outside air taken into the housing flows in the take-in channel in which the humidity detection portion is provided, it is difficult for foreign matter to adhere to the humidity detection portion. Accordingly, it is possible to suppress the precision of detection of the outside air humidity from being decreased due to the adhesion of the foreign matter to the humidity detection portion.

A control device of a droplet discharge apparatus according to another aspect of the invention, which executes a droplet discharge job defining a mode for discharging droplets of a discharge portion to a medium, before the droplet discharge job is executed, calculates a discharge amount fluctuation, which is a fluctuation in a discharge amount of liquid per unit time by the discharge portion, based on the droplet discharge job, and determines whether or not maintenance for recovering droplet discharge performance of the discharge portion is required at the time of executing the droplet discharge job based on the discharge amount fluctuation.

According to the above configuration, in the control device of a droplet discharge apparatus, it is possible to acquire the same effects as those of the above-described droplet discharge apparatus.

A control method of a droplet discharge apparatus according to still another aspect of the invention executing a droplet discharge job defining a mode for discharging droplets of a discharge portion to a medium includes, before the droplet discharge job is executed, calculating a discharge amount fluctuation, which is a fluctuation in a discharge amount of liquid per unit time by the discharge portion, based on the droplet discharge job, and determining whether or not maintenance for recovering droplet discharge performance of the discharge portion is required at the time of executing the droplet discharge job based on the discharge amount fluctuation.

According to the above configuration, in the control method of the droplet discharge apparatus, it is possible to acquire the same effects as those of the above-described droplet discharge apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of a droplet discharge apparatus will be described with reference to the drawings. A droplet discharge apparatus according to the present embodiment is a large format printer printing characters or images by discharging ink droplets as an example of droplets to a long medium (paper).

Figure 1:
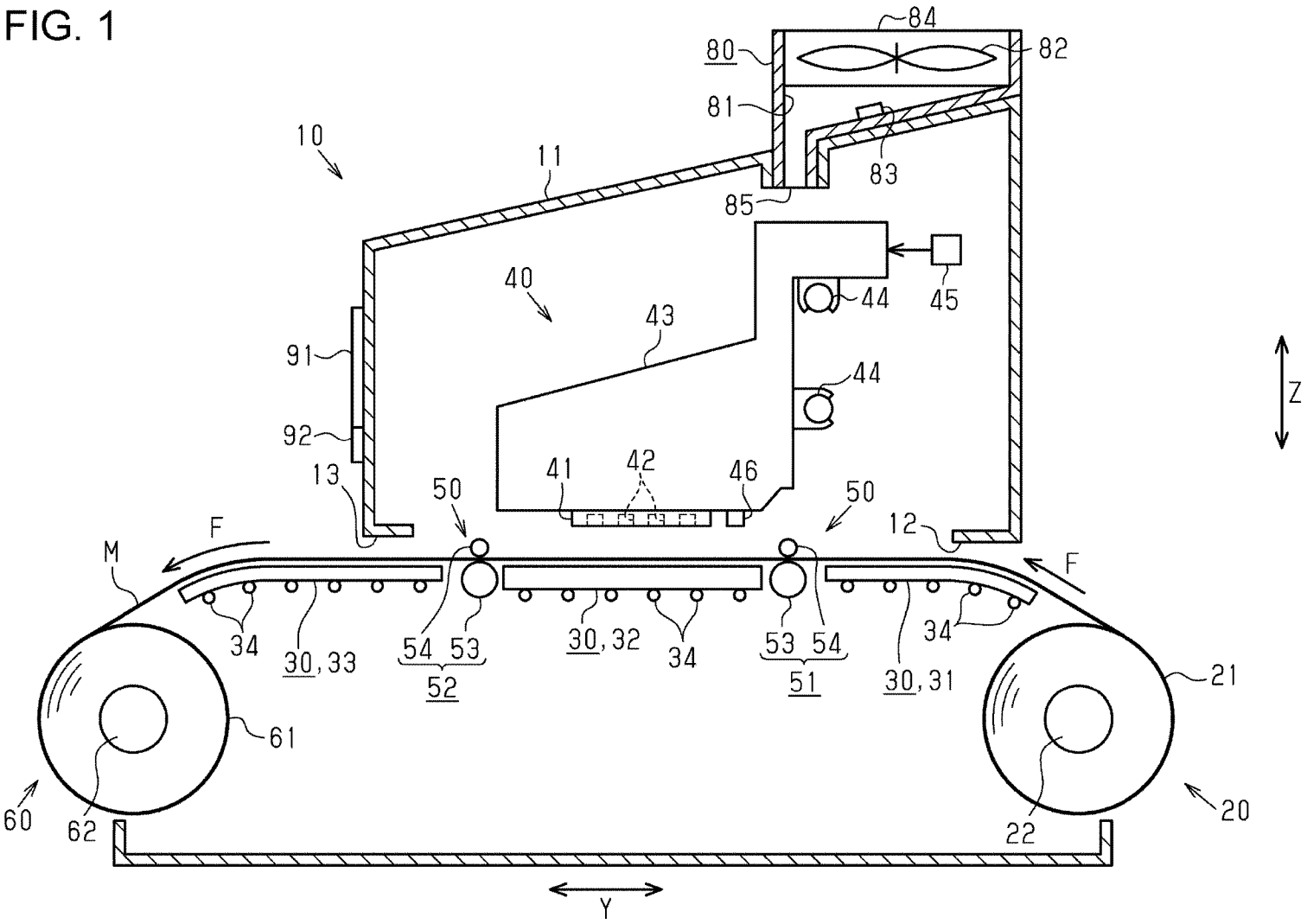
FIG. 1 is a side view of a printing apparatus according to an embodiment.

As illustrated in FIG. 1, a printing apparatus 10 includes a housing 11, a feeding portion 20 that feeds a medium M, a support portion 30 that supports the medium M, a printing portion 40 that performs printing on the medium M, and a transport portion 50 that transports the medium M, and a winding portion 60 that winds the medium M. In addition, as illustrated in FIGS. 1 and 2, the printing apparatus 10 includes a maintenance portion 70 that executes maintenance of the printing portion 40, a ventilation portion 80 that ventilates an inside of the housing 11, a display portion 91 that displays various kinds of information of the printing apparatus 10, and an operation portion 92 that is operated by a user.

In the following description, it should be noted that a width direction of the printing apparatus 10 is defined as a "width direction X", a front and rear direction of the printing apparatus 10 is defined as a "front and rear direction Y", an up and down direction of the printing apparatus 10 is defined as a "vertical direction Z", and a direction in which the medium M is transported is defined as a "transport direction F". In the present embodiment, the width direction X, the front and rear direction Y, and the vertical direction Z are directions intersecting with (orthogonal to) each other, and the transport direction F is a direction intersecting with (orthogonal to) the width direction X.

As illustrated in FIG. 1, the feeding portion 20 includes a feeding shaft 22 that rotates integrally with a roll body 21 around which a long medium M is wound. In addition, the feeding portion 20 rotates the feeding shaft 22 in a counterclockwise direction in FIG. 1 to feed the medium M downstream in the transport direction. In addition, it is preferable that the feeding portion 20 adjust the rotational speed of the feeding shaft 22 so that "wrinkles" or "kinks" do not occur in the medium M fed downstream in the transport direction, thereby allowing tension to act on the medium M.

Figure 2:
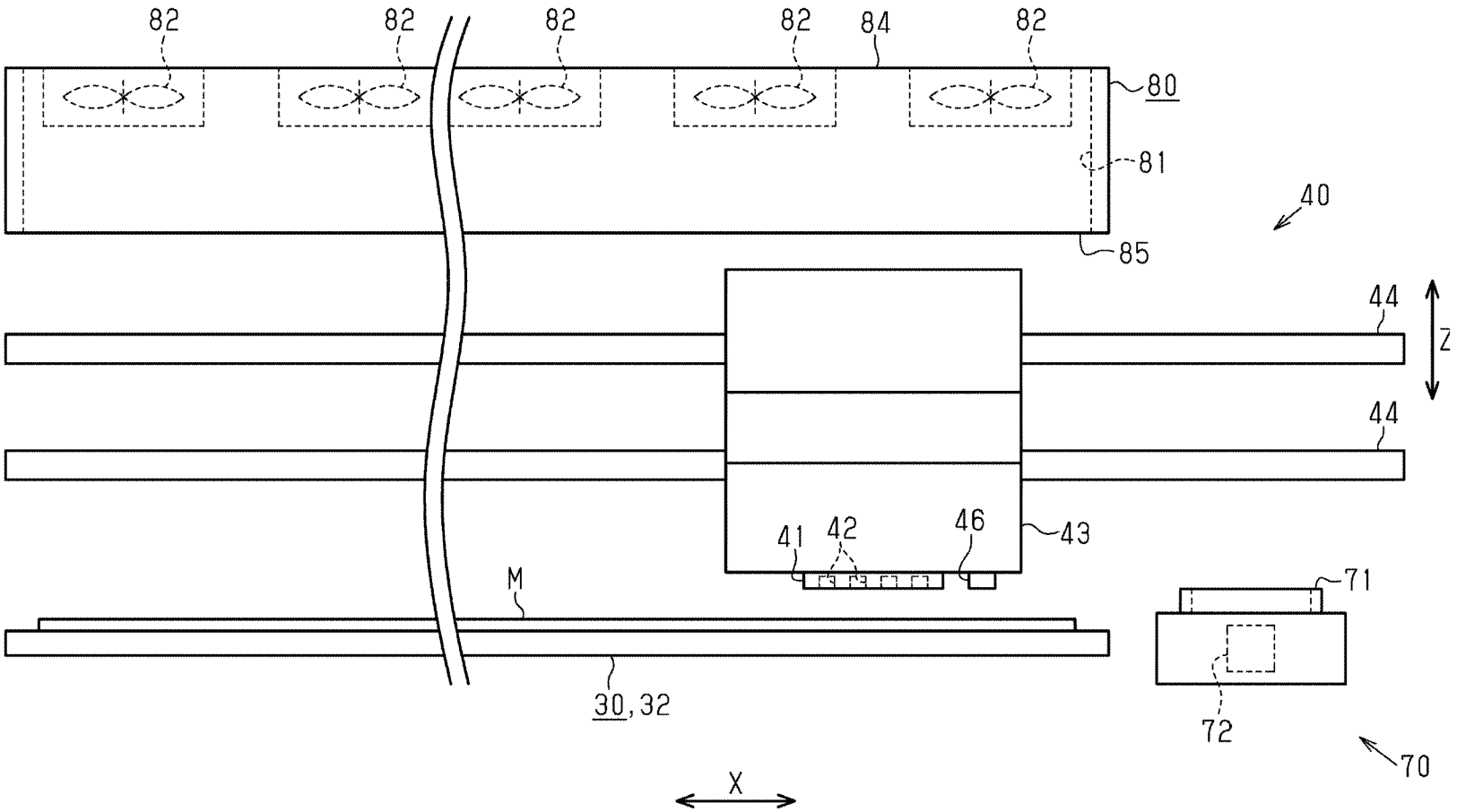
FIG. 2 is a front view of an internal configuration of the printing apparatus.

As illustrated in FIG. 1 and FIG. 2, the support portion 30 includes a first support portion 31, a second support portion 32, and a third support portion 33 along the transport direction F. Further, the support portion 30 includes heating portions 34 heating the medium M via the first support portion 31, the second support portion 32, and the third support portion 33.

The first support portion 31, the second support portion 32, and the third support portion 33 have a plate shape in which they extend in the width direction X and the transport direction F. The first support portion 31 guides the medium M fed from the feeding portion 20 toward the second support portion 32, the second support portion 32 supports the medium M printed by the printing portion 40, and the third support portion 33 guides the printed medium M toward the winding portion 60. In addition, the heating portion 34 may be a heating element that generates heat by electric conduction, may be a rod heater whose width direction X is a longitudinal direction as illustrated in FIG. 1, or may be a surface heater.

As illustrated in FIGS. 1 and 2, the printing portion 40 includes a discharge portion 41 that has a plurality of nozzles 42 discharging ink, a carriage 43 that supports the discharge portion 41 so that the nozzles 42 open toward the second support portion 32, and a guide shaft 44 that movably supports the carriage 43 in the width direction X. In addition, the printing portion 40 includes a moving mechanism 45 that is a driving source moving the carriage 43 in the width direction X and a temperature detection portion 46 that is disposed so as to be adjacent to the discharge portion in the carriage 43. In should be noted that in the ink of the present embodiment, "water" may be used as a solvent.

Figure 3:
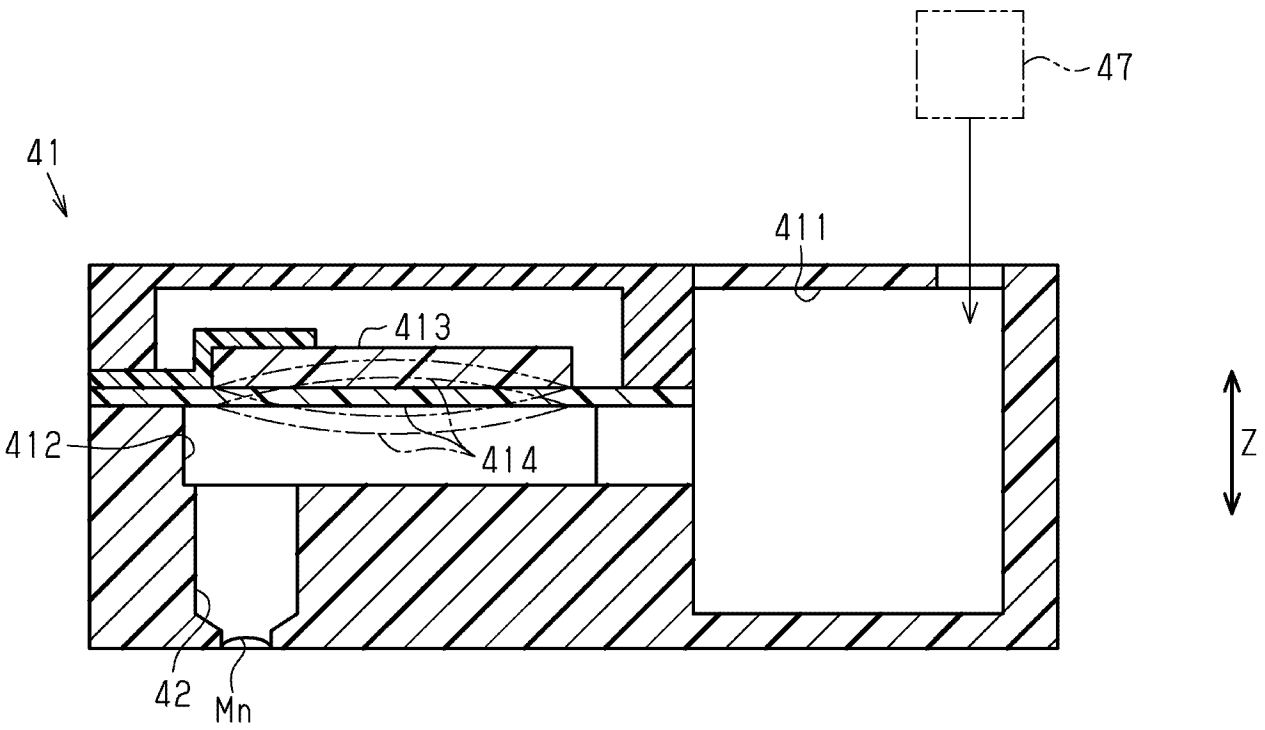
FIG. 3 is a cross-sectional view illustrating an internal configuration of a discharge portion of the printing apparatus.

As illustrated in FIG. 3, the discharge portion 41 (ink jet head) includes a common liquid chamber 411 that temporarily stores ink supplied from an ink supply source 47, a plurality of cavities 412 that are provided so as to correspond to the plurality of nozzles 42, respectively, and a plurality of actuators 413 (piezoelectric elements) that are provided so as to correspond to the cavities 412, respectively. A wall of the cavity 412 with which the actuator 413 is in contact becomes a vibration wall 414 capable of being deflection-displaced in directions in which a volume of the cavity 412 is increased and decreased.

When the actuator 413 is contracted and deformed by electric conduction, the vibration wall 414 of the cavity 412 is elastically deformed in the direction in which the volume of the cavity 412 is increased as illustrated by a two-dot chain line in FIG. 3. When the volume of the cavity 412 is increased, the ink stored in the common liquid chamber 411 is introduced into the cavity 412. Thereafter, when the electric conduction stops, the vibration wall 414 of the cavity 412 with which the actuator 413 is in contact is elastically deformed in the direction in which the volume of the cavity 412 is decreased as illustrated by one dot chain line in FIG. 3, due to a reaction by which the contraction of the actuator 413 is released.

In this case, the volume of the cavity 412 is sharply decreased, such that the ink in the cavity 412 is extruded into the nozzle 42 and the extruded ink is discharged from the nozzle 42. After the ink is discharged, the ink is replenished into the nozzle 42 as much as the amount discharged from the cavity 412 that becomes an upstream side due to a capillary force.

In addition, the capillary force acts on the nozzle 42 which is a thin tubular hole. Therefore, in a state where the actuator 413 is not driven, a meniscus Mn which is a concave liquid surface is formed in the nozzle 42.

The printing portion 40 performs printing corresponding to one pass by discharging the ink from the nozzle 42 of the discharge portion 41 toward the medium M while reciprocating the carriage 43 in the width direction X. Further, the printing portion 40 may perform printing on the medium M by discharging the ink from the discharge portion 41 when the carriage 43 moves in only one direction in the width direction X, that is, unidirectional printing. Alternatively, the printing portion 40 may perform printing on the medium M by discharging the ink from the discharge portion 41 when the carriage 43 moves in both directions in the width direction X, that is, bidirectional printing.

As illustrated in FIG. 1, the transport portion 50 includes a first transport portion 51 that is disposed on an upstream side of the second support portion 32 in the transport direction and a second transport portion 52 that is disposed on a downstream side of the second support portion 32 in the transport direction. Each of the first transport portion 51 and the second transport portion 52 includes a driving roller 53 that applies a transport force to the medium M and a driven roller 54 that presses the medium toward the driving roller 53. The transport portion 50 transports the medium M to the downstream side by driving the driving roller 53 in a state where the medium M is pinched between the driving roller 53 and the driven roller 54.

As illustrated in FIG. 1, the winding portion 60 includes a winding shaft 62 that rotates integrally with a roll body 61 around which the long medium M is wound. The winding portion 60 rotates the winding shaft 62 counterclockwise in FIG. 1 to wind the medium M. In addition, it is preferable that the winding portion 60 adjust a rotational speed of the feeding shaft 22 so that "wrinkles" or "kinks" do not occur in the medium M, thereby allowing tension to act in the longitudinal direction of the medium M, like the feeding portion 20.

As illustrated in FIG. 2, the maintenance portion 70 is provided at an adjacent position (hereinafter, referred to as a "home position") to the first support section 31 in the width direction X. In addition, the maintenance portion 70 has a cap 71 that has an opening disposed vertically upward and has a box shape and a decompression portion 72 that decompresses a space inside the cap 71. The cap 71 can be elevated in the vertical direction Z so as to be in contact with the discharge portion 41 of the carriage 43 disposed at the home position, thereby performing "capping" that turns a space opened by the nozzle 42 of the discharge portion 41 into a closed space.

The maintenance portion 70 drives the decompression portion 72 in a state where the capping is performed, such that the closed space is decompressed and cleaning is thus performed to forcibly discharge the ink from the nozzle 42. The cleaning is an example of the maintenance that is executed to turn the nozzle 42 (hereinafter referred to as a "defective nozzle") that causes a discharge defect of the ink into the nozzle 42 (hereinafter referred to as a "normal nozzle") that may normally discharge the ink.

As illustrated in FIGS. 1 and 2, the ventilation portion 80 includes a take-in channel 81 through which gas flows, a blowing portion 82 that blows the gas, a humidity detection portion 83 that detects humidity of the gas flowing in the take-in channel 81. The take-in channel 81 is disposed to communicate the inside and the outside of the housing 11 with each other. In addition, the take-in channel 81 is provided an inlet 84 that is open toward the outside of the housing 11 and an outlet 85 that is open toward the inside of the housing 11.

In addition, as illustrated in FIG. 2, a plurality of blowing portions 82 are disposed along the width direction X in the take-in channel 81. The blowing portion 82 may be a blowing fan that blows gas, may be a centrifugal fan, or an axial flow fan. The humidity detection portion 83 is disposed inside the take-in channel 81 so as to be positioned outside the housing 11. In addition, the humidity detection portion 83 may be of a capacitive type or may be of a resistive type.

The ventilation portion 80 drives the blowing portion 82 to blow outside air taken into the housing 11 via the take-in channel 81 toward an area where the carriage 43 reciprocates. In this way, floating matter such as ink mist floating inside the housing 11 is discharged to the outside of the housing 11 via a supply port 12 and a discharge port 13 that are provided in the housing 11, by an air flow generated inside the housing 11.

Further, the ventilation section 80 blows gas into the blowing portion to ventilate the inside of the housing 11. Here, a ventilation rate of the housing 11 by the ventilation portion 80 may be set to be, for example, a degree at which the gas in the housing is exchanged several times per 1 minute.

The display portion 91 may be, for example, a liquid crystal screen, and displays information on setting of the printing apparatus 10, printing information, and the like. In addition, the operation portion 92 may be, for example, a soft key that is displayed on the liquid crystal screen or a physical key that can be pressed physically. The operation portion 92 is operated by a user when the setting of the printing apparatus 10 is changed or when the printing apparatus 10 performs printing.

Next, an electrical configuration of the printing apparatus 10 will be described with reference to FIG. 4.

Figure 4:
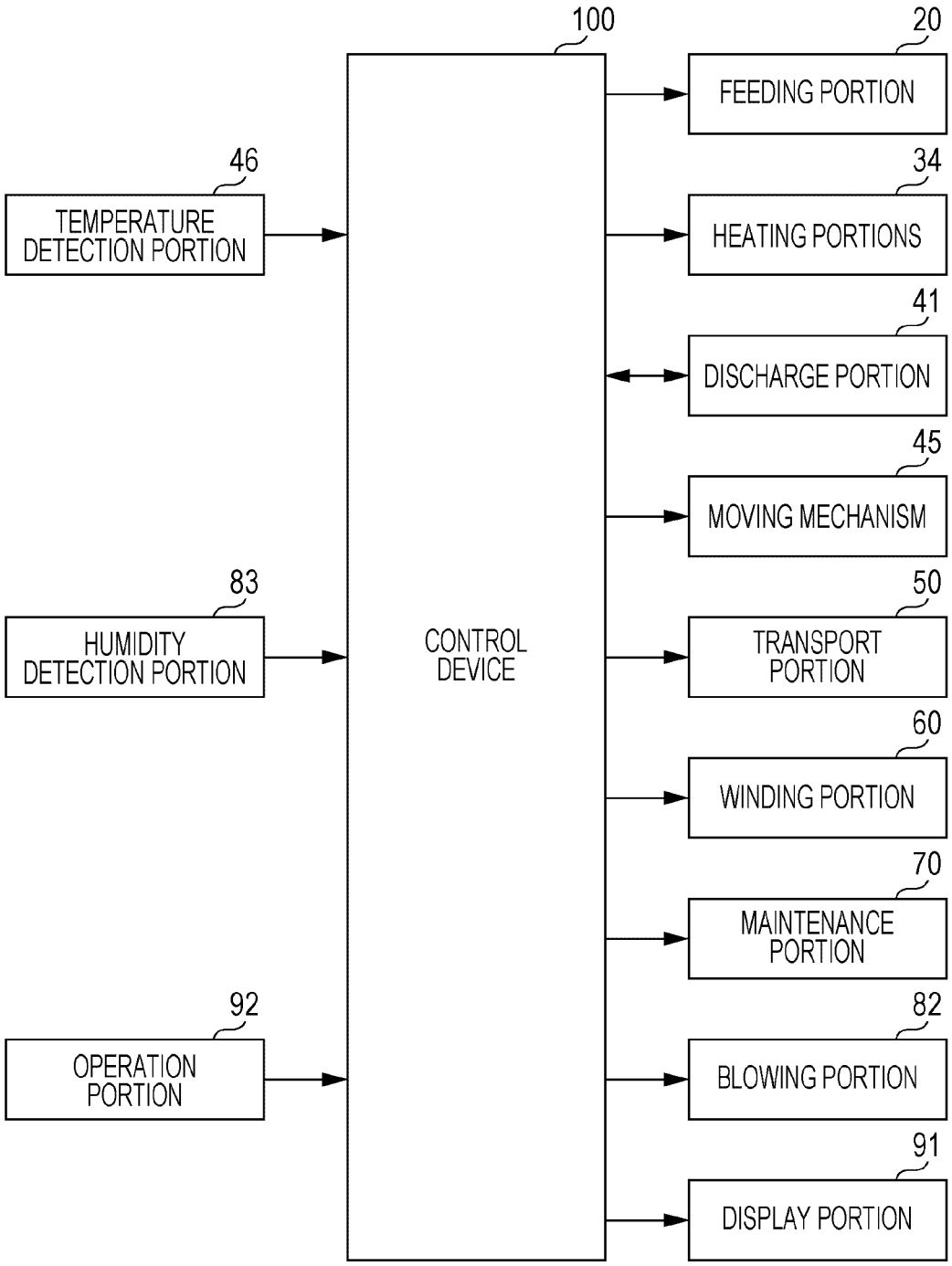
FIG. 4 is a block diagram illustrating an electrical configuration of the printing apparatus.

As illustrated in FIG. 4, the printing apparatus 10 is provided with a control device 100 that generally controls the printing apparatus 10. The discharge portion 41 (actuator 413), the temperature detection portion 46, the humidity detection portion 83, and the operation portion 92 are connected to an input side interface of the control device 100. In addition, the feeding portion 20, the heating portion 34, the discharge portion 41, the moving mechanism 45, the transport portion 50 (driving roller 53), the winding portion 60, the maintenance portion 70, the blowing portion 82, and the display portion 91 are connected to an output side interface of the control device 100.

The temperature detection portion 46 transmits a detection signal depending on a temperature in the vicinity of a nozzle (hereinafter, also referred to as a "nozzle ambient temperature Tn") to the control device 100. In addition, the humidity detection portion 83 transmits a detection signal depending on the humidity of outside air (hereinafter, referred to as "outside air humidity Ho") flowing in the take-in channel 81 to the control device 100. It should be noted that the nozzle ambient temperature Tn is, for example, a temperature of a nozzle surface to which the nozzle 42 opens in the discharge portion 41.

When a print job that defines a content (print content) to be formed by discharging ink is input from a terminal (not illustrated), the control device 100 performs printing based on the print job. In detail, the control device 100 alternately performs a transport operation that transports the medium M in the transport direction F by unit transport amount and a discharge operation that discharges ink from the discharge portion 41 while moving the carriage 43 in the width direction X, thereby performing printing. In this respect, in the present embodiment, the print job corresponds to an example of a "droplet discharge job" defining a mode for discharging droplets to the medium.

In the printing apparatus 10 according to the present embodiment, a print job for performing printing on the long medium M of which a length in the transport direction F is longer than a length in the width direction X is input. That is, the printing apparatus 10 according to the present embodiment takes a longer time from the start of one print job to the end thereof, as compared with the case of performing printing on cut paper.

In addition, the control device 100 detects a defective nozzle based on an output of the actuator 413. Here, a discharge defect of ink in the defective nozzle occurs due to various state changes inside and outside the nozzle 42, but in the present embodiment, the discharge defect may occur due to drying of the nozzle 42. In detail, in the case where there is the nozzle 42 that does not discharge ink over a long period of time, since the viscosity of ink that forms the meniscus Mn in the nozzle 42 is increased (that is, the ink is solidified), a discharge defect of the ink may occur.

In the present embodiment, when a drive voltage is applied to the actuator 413, the vibration wall 414 provided in the discharge portion 41 is vibrated (residually vibrates) while being attenuated until the next drive voltage is applied. In this way, in the case where the vibration wall 414 residually vibrates, the actuator 413 outputs a signal in response to the residual vibration of the vibration wall 414, unlike the case where the vibration wall 414 is vibrated by the application of the drive voltage.

On the other hand, a vibration mode of the residual vibration of the vibration wall 414 in the normal nozzle and a vibration mode of the residual vibration of the vibration wall 414 in the defective nozzle are different from each other. In detail, in the case where the viscosity of ink is increased in the nozzle 42, a frequency of the residual vibration of the vibration wall 414 tends to be lower than that in the case where the viscosity of ink is not increased in the nozzle 42. Therefore, the control device 100 compares a frequency of an output signal of the actuator 413 output in response to the residual vibration of the vibration wall 414 with a frequency of the output signal in a normal state to determine whether a target nozzle 42 to be inspected is a normal nozzle or a defective nozzle.

In the printing apparatus 10, when the defective nozzle is detected during the execution of the print job, it is preferable to interrupt printing and at the same time, execute maintenance (cleaning) in order to deal with the discharge defect of ink of the defective nozzle. However, in this case, the printing is interrupted, and printing unevenness (banding) may occur on a boundary between an image printed before the maintenance is executed and an image printed after the maintenance is executed. That is, when the maintenance is executed at the time of executing the print job, there is a risk that a printing result desired by a user cannot be acquired.

On the other hand, since a nozzle is more likely to become defective as the nozzle 42 more easily dries, the occurrence frequency of the defective nozzle is greatly affected by the humidity in the vicinity of the nozzle 42 (hereinafter, referred to as "nozzle ambient humidity Hn"). In detail, when the nozzle ambient humidity Hn is low, the occurrence frequency of the defective nozzle tends to be high due to the drying of the nozzle 42, and when the nozzle ambient humidity Hn is high, the occurrence frequency of the defective nozzle tends to be low due to humidity retention of the nozzle 42. It should be noted that the nozzle ambient humidity Hn is humidity of an area that the nozzle surfaces of the discharge portion 41 face, in other words, an area between the second support portion 32 and the discharge portion 41 supported by the carriage 43 reciprocating in the width direction X.

In addition, in the printing apparatus 10, since the discharge portion 41 reciprocates in the area facing the second support portion 32 in the width direction X in a state where it is supported by the carriage 43, when the printing is performed on the medium M, a solvent of ink discharged from the nozzle 42 to the medium M is evaporated in the area in the vicinity of the nozzle 42 (discharge portion 41). Therefore, when a state in which a discharge amount of ink to the medium M is large continues, an evaporation amount of solvent of the ink discharged to the medium M is increased, and when a state in which a discharge amount of ink to the medium M is small continues, an evaporation amount of solvent of the ink discharged to the medium M is decreased. In this way, since the nozzle ambient humidity Hn in the case where the discharge amount of ink to the medium M is large becomes higher than that in the case where the discharge amount of ink is small, the nozzle ambient humidity Hn can be estimated (calculated) when the discharge amount of ink is known. In detail, a map or a conversion formula that indicates a tendency of a change in the nozzle ambient humidity Hn to a change in the discharge amount of ink can be acquired by performing an experiment or a simulation in advance.

In addition, the print job defines modes for discharging ink to the medium M such as the discharge amount, discharge position, and discharge timing of ink to the medium M. Therefore, the control device 100 can analyze the contents of the print job before the print job is executed, thereby calculating a fluctuation in the discharge amount of ink (hereinafter, referred to as a "discharge amount fluctuation VD") to the medium M per unit time. Accordingly, the control device 100 can calculate a fluctuation in the nozzle ambient humidity Hn (hereinafter, referred to as a "humidity fluctuation VH") per unit time based on the discharge amount fluctuation VD before the print job is executed.

Next, an example of the humidity fluctuation VH will be described with reference to FIG. 5.

Figure 5:
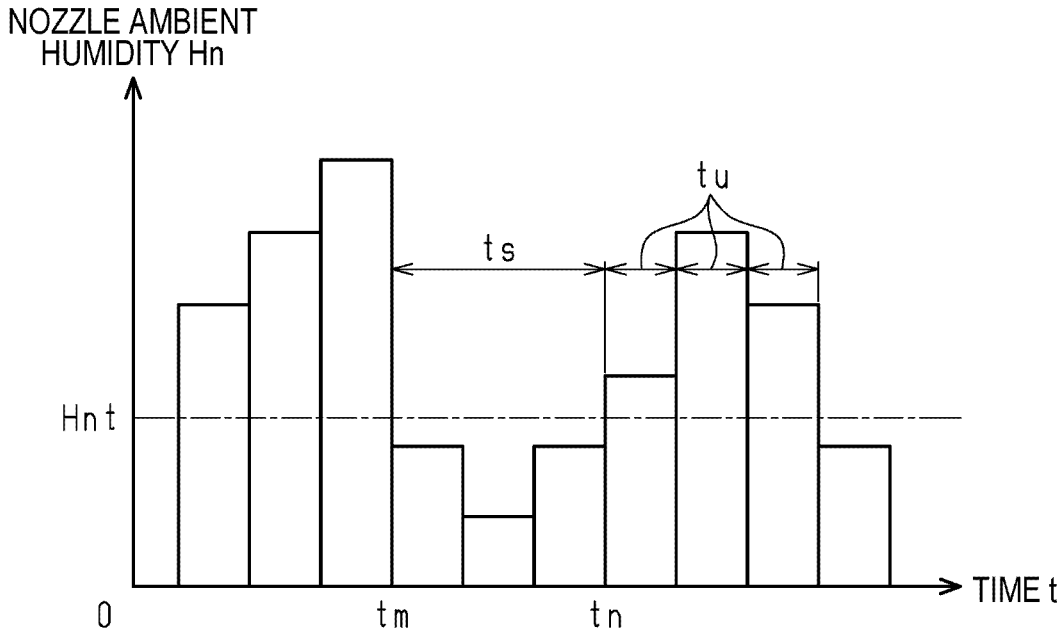
FIG. 5 is a graph illustrating an example of a fluctuation in nozzle ambient humidity per unit time.

As illustrated in FIG. 5, the humidity fluctuation VH shows a fluctuation in the nozzle ambient humidity Hn to the passage of time per unit time tu, and can be calculated only after the print job is input to the printing apparatus 10. Here, the unit time tu may be time required for executing a pass a predetermined number of times (for example, 50 times), and may be any duration (for example, 10 minutes). In addition, in the case where the discharge amount of ink to the medium M per unit time tu is large like a print job or the like for printing an image or the like and in the case where the discharge amount of ink to the medium M per unit time tu is small like a print job or the like for printing characters or the like, the unit time tu may be changed. However, the unit time tu is shorter than the time required for executing the print job.

In addition, in the following description, the nozzle ambient humidity Hn which serves as a threshold value indicating whether the drying of the nozzle 42 has progressed is defined as a "reference humidity Hnt". That is, when the nozzle ambient humidity Hn is less than the reference humidity Hnt, the drying of the nozzle 42 has markedly progressed, whereas when the nozzle ambient humidity Hn is equal to or more than the reference humidity Hnt, the drying of the nozzle 42 has negligibly progressed.

In addition, a period that elapses from after the nozzle ambient humidity Hn is less than the reference humidity Hnt until a nozzle becomes defective in a state where the nozzle ambient humidity Hn is less than the reference humidity Hnt is defined as a "determination period ts". That is, when the state in which the nozzle ambient humidity Hn is less than the reference humidity Hnt continues for the determination period ts or more, a discharge defect occurs in the nozzle 42. In addition, when the nozzle ambient humidity Hn is equal to or more than the reference humidity Hnt after the nozzle ambient humidity Hn is less than the reference humidity Hnt for a period shorter than the determination period ts, the ink in the nozzle 42 absorbs moisture and a dried state of the nozzle 42 is therefore reset.

In addition, since the reference humidity Hnt and the determination period ts are affected even by specifications of the discharge portion 41 and components of the ink, it is preferable that the reference humidity Hnt and the determination period ts be acquired in advance from an experiment using an actual machine, a simulation simulating the actual machine or the like. In addition, although the reference humidity Hnt may change depending on the characteristics of a solvent of the ink, for example, it may be set to about 30%.

In the case where the humidity fluctuation VH illustrated in FIG. 5 is acquired, for example, if the determination period ts corresponds to three times the unit time tu, it is expected that a nozzle will become defective in a range from an m-th timing tm at which the nozzle ambient humidity Hn is equal to or less than the reference humidity Hnt to an n-th timing to after the determination period ts elapses.

In addition, in the case of calculating the humidity fluctuation VH, it is preferable to increase precision of calculation of the humidity fluctuation VH by considering variables indicating a state in the housing 11 described below.

When the discharge amount of ink to the medium M is constant, in the case where the nozzle ambient temperature Tn is high, the evaporation amount of solvent of the ink discharged to the medium M becomes larger than that in the case where the nozzle ambient temperature Tn is low. Therefore, it is preferable that the control device 100 calculate the humidity fluctuation VH on the basis of the nozzle ambient temperature Tn.

In addition, when the discharge amount of ink to the medium M is constant, in the case where the outside air humidity Ho of the outside air taken into the housing 11 is low, the nozzle ambient humidity Hn becomes lower than that in the case where the outside air humidity Ho is high. Therefore, it is preferable that the control device 100 calculate the humidity fluctuation VH on the basis of the outside air humidity Ho.

In addition, when the discharge amount of ink to the medium M is constant and the outside air humidity is lower than the humidity in the housing 11, in the case where a ventilation rate of the outside air taken into the housing 11 is high, the nozzle ambient humidity Hn becomes lower than that in the case where the ventilation rate is low. Therefore, it is preferable that the control device 100 calculate the humidity fluctuation VH on the basis of the ventilation rate of the outside air. It should be noted that the ventilation rate may be acquired on the basis of a driving aspect (rotational speed) of the blowing portion 82 by the control device 100.

As described above, in the present embodiment, the control device 100 analyzes the contents of the print job before the print job is executed and considers the variables indicating the state in the housing 11 in order to calculate the fluctuation (humidity fluctuation VH) in the nozzle ambient humidity Hn per unit time to at the time of executing the print job.

When the state in which the nozzle ambient humidity Hn is equal to or less than the reference humidity Hnt does not continue over the determination period ts in the humidity fluctuation VH, the control device 100 determines that a nozzle does not become defective during the execution of the print job and the maintenance is thus not required. On the other hand, when the state in which the nozzle ambient humidity Hn is equal to or less than the reference humidity Hnt continues over the determination period ts in the humidity fluctuation VH, the control device 100 determines that a nozzle becomes defective during the execution of the print job and the maintenance is thus required.

Since the humidity fluctuation VH is calculated based on the discharge amount fluctuation VD, it may be said that the control device 100 according to the present embodiment determines whether or not the maintenance is required at the time of the execution of the print job based on the discharge amount fluctuation VD.

Next, processes (control method) performed when the control device 100 according to the present embodiment executes the print job will be described with reference to a flow chart illustrated in FIG. 6.

Figure 6:
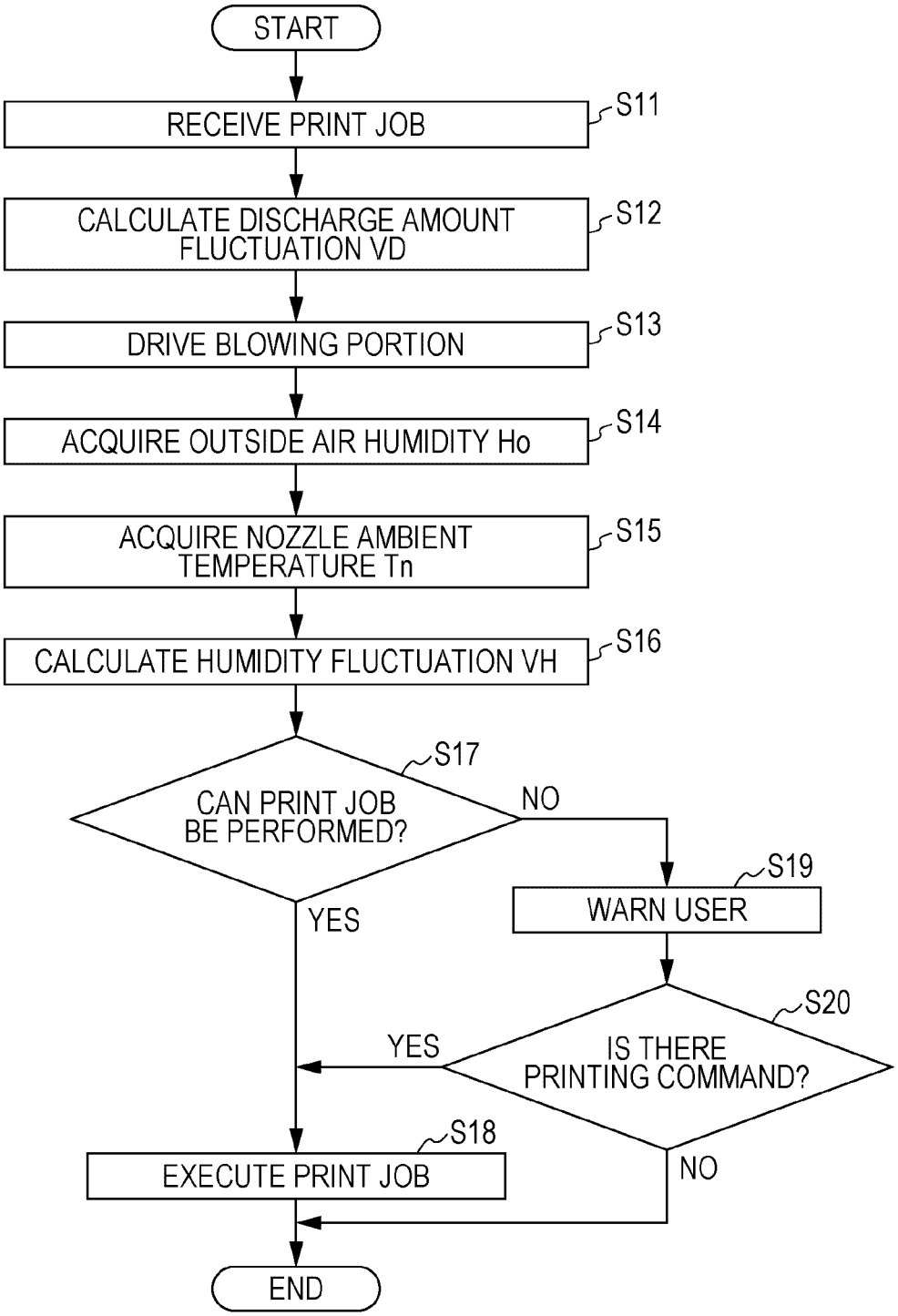
FIG. 6 is a flow chart illustrating a flow of processes executed by a control device in executing a print job.

As illustrated in FIG. 6, when receiving the print job from a terminal (not shown) (step S11), the control device 100 calculates the discharge amount fluctuation VD which is the discharge amount of ink to the medium M per unit time to based on the print job (step S12). Next, the control device 100 drives the blowing portion 82 (step S13), and acquires the outside air humidity Ho of the outside air taken into the housing 11 based on a detection result of the humidity detection portion 83 (step S14).

The control device 100 acquires the nozzle ambient temperature Tn based on a detection result of the temperature detection portion 46 (step S15), and calculates the humidity fluctuation VH based on the discharge amount fluctuation VD, the outside air humidity Ho, and the nozzle ambient temperature Tn that are acquired in advance (step S16).

Next, the control device 100 determines whether or not the print job can be executed without executing the maintenance (step S17). In detail, the control device 100 determines whether or not the state where the nozzle ambient humidity Hn is less than the reference humidity Hnt continues over the determination period is in the humidity fluctuation VH calculated in the previous step S16.

When the execution of the print job can be completed without executing the maintenance during the execution of the print job (step S17: YES), that is, when it is determined that the state where the nozzle ambient humidity Hn is less than the reference humidity Hnt does not continue over the determination period ts and thus a nozzle does not become defective at the time of the execution of the print job, the control device 100 executes the print job (step S18).

In addition, in step S18, when the ink is discharged from the nozzle 42 of the discharge portion 41 to the medium M or flushing that discharges ink, regardless of printing, between the passes is performed during the execution of the print job, it is determined whether or not a nozzle becomes defective. When a nozzle actually becomes defective during the execution of the print job, the maintenance is executed in order to solve a discharge defect of the defective nozzle. Next, when the execution of the print job is completed, the control device 100 ends a series of processes.

In addition, when the print job cannot be executed without executing the maintenance on the way (step S17: NO), that is, when it is determined that the state where the nozzle ambient humidity Hn is less than the reference humidity Hnt continues over the determination period ts and thus a nozzle becomes defective at the time of executing the print job, the control device 100 warns (notifies) a user of such a fact (step S19).

For example, in step S19, the control device 100 displays, on the display portion 91, the fact that there is a risk that the maintenance for recovering the discharge defect of the defective nozzle is executed during the execution of the print job when the print job is executed as is. In addition, in step S19, options selected by a user as to whether the print job is executed or the execution of the print job stops while the maintenance is allowed to be executed during the execution of the print job are displayed.

Next, the control device 100 waits for a user's selection (command) in order to determine contents to be processed later, and when there is a printing command from the user (step S20: YES), the control device 100 executes the print job (step S18) and when there is no printing command from the user (step S20: NO), the control device 100 does not execute and ends a series of processes.

In this way, in the present embodiment, when there is the possibility that the maintenance will be executed during the execution of the print job, the control device warns the user of such a fact in order to allow the user to select whether or not to execute the print job.

In step S20, in the case where there is the printing command, the user may select an option that allows the execution of the maintenance when a nozzle actually becomes defective at the time of executing the print job and an option that inhibits the execution of the maintenance even when a nozzle actually becomes defective at the time of executing the print job.

In addition, in the present embodiment, step S12 corresponds to an example of a "calculation step" of calculating the discharge amount fluctuation VD which is the fluctuation in the discharge amount of ink by the discharge portion 41 per unit time tu, and step S17 corresponds to an example of a "determination step" of determining whether or not the execution of the maintenance of the discharge portion 41 is required at the time of the execution of the print job.

Next, an operation of the printing apparatus 10 according to the present embodiment will be simply described.

When the print job is input to the printing apparatus 10 according to the present embodiment, it is determined whether or not the print job can be executed without executing the maintenance (cleaning). When it is determined that the execution of the print job can be completed without executing the maintenance, the print job is executed. On the other hand, when it is determined that the execution of the print job cannot be executed without executing the maintenance, such a fact is displayed on the display portion 91.

In the case where the fact that the print job cannot be executed is displayed on the display portion 91, when the user confirming the contents displayed on the display portion 91 performs the printing command, the print job is executed. However, in the case where the user performs the printing command, it is highly likely that a nozzle will become defective during the execution of the print job and in the case where a nozzle actually becomes defective, the maintenance is executed. However, since the user performs the printing command after allowing the execution of the maintenance, even if the maintenance is actually executed, there is no case where the maintenance is executed without being expected by the user.

In addition, in the case where the fact that the print job cannot be executed is displayed on the display portion 91, when the user confirming the contents displayed on the display portion 91 performs a printing stop command, the print job is not executed. That is, in this case, there is no case where the maintenance is executed without being expected by the user during the execution of the print job.

According to the embodiment as described above, the following effects can be acquired.

(1) The control device 100 calculates the discharge amount fluctuation VD from the print job, and determines whether or not the execution of the maintenance is required during the execution of the print job based on the discharge amount fluctuation VD. Therefore, when it is determined that the maintenance is required at the time of executing the print job, it is possible to notify a user of such a fact before the print job is executed. Accordingly, it is possible to suppress the maintenance which is not expected by the user, from being executed.

(2) When the state where the nozzle ambient humidity Hn per unit time tu is less than the reference humidity Hnt continues in the humidity fluctuation VH, it is determined that the maintenance is required during the execution of the print job. That is, since it is determined whether the maintenance is required by comparing the nozzle ambient humidity Hn per unit time tu with the reference humidity Hnt in the humidity fluctuation VH, it is possible to easily perform the determination.

(3) Even when the discharge amount of ink is uniform, the evaporation amount of solvent of the ink discharged to the medium M may be increased when the nozzle ambient temperature Tn is high, whereas the evaporation amount of solvent of the ink discharged to the medium M may be decreased when the nozzle ambient temperature Tn is low, that is, even when the discharge amount of ink is uniform, the nozzle ambient humidity Hn may be changed depending on the nozzle ambient temperature Tn. In this aspect, according to the present embodiment, since the humidity fluctuation VH is calculated based on the nozzle ambient temperature Tn, it is possible to suppress the precision of calculation of the humidity fluctuation VH from being decreased. That is, it is possible to increase the precision of determination of whether or not the maintenance is required.

(4) Since the nozzle ambient humidity Hn is calculated based on the nozzle ambient temperature Tn that is acquired based on the detection result of the temperature detection portion 46, it is possible to increase the precision of calculation of the nozzle ambient humidity Hn (humidity fluctuation VH).

(5) Since the ventilation portion 80 can ventilate the inside of the housing 11 by taking the outside air into the housing 1, it is possible to suppress dew condensation in the vicinity (for example, nozzle surface) of the nozzle 42 due to the increase in the nozzle ambient humidity Hn. In addition, when the inside of the housing is ventilated, since the outside air humidity Ho of the outside air taken in for ventilation affects the nozzle ambient humidity Hn, it is possible to suppress the precision of calculation of the humidity fluctuation VH from being decreased by calculating the humidity fluctuation VH based on the outside air humidity Ho.

(6) When the humidity detection portion 83 is disposed inside the housing 11, foreign matter such as dust and fluff may adhere to the humidity detection portion 83 or the ink may adhere to the humidity detection portion 83 thereby decreasing the measurement accuracy of the humidity detection portion 83. In this aspect, according to the present embodiment, since the outside air taken into the housing 11 flows in the take-in channel 81 in which the humidity detection portion 83 is provided, it is difficult for foreign matter to adhere to the humidity detection portion 83. Accordingly, it is possible to suppress the precision of detection from being decreased due to the adhesion of the foreign matter to the humidity detection portion 83.

In addition, the take-in channel 81 in which the humidity detection portion 83 is disposed is provided outside the housing 11. Therefore, since there is little influence of heat generation from various components provided in the housing 11, it is possible to suppress the precision of detection of the humidity detection portion 83 from being decreased.

It should be noted that the above embodiment may be changed as follows.

The printing apparatus 10 may not include the temperature detection portion 46. In this case, it is preferable that the control device 100 acquire the nozzle ambient temperature Tn on the basis of a driving mode of the heating portion 34. For example, the relationship between the power consumption of the heating portion 34 and the nozzle ambient temperature Tn may be acquired in advance by experimentation or the like, and the nozzle ambient temperature Tn may be estimated depending on the power consumption when the heating portion 34 is driven. In this case, since the nozzle ambient temperature Tn is calculated based on the driving mode of the heating portion 34, there is no need to provide a component for detecting the nozzle ambient temperature Tn. Therefore, it is possible to simplify the configuration of the printing apparatus.

The control device 100 may calculate the nozzle ambient humidity Hn on the basis of at least the discharge amount fluctuation VD. For example, the control device 100 may also determine that the execution of the maintenance is required during the execution of the print job when the state in which the discharge amount of ink is small continues in the discharge amount fluctuation VD.

The control device 100 may calculate the nozzle ambient humidity Hn based on variables that are not been used in the above embodiment and indicate a state in the housing 11. For example, the control device 100 may calculate the nozzle ambient humidity Hn based on a volume of the housing 11, an amount of moisture contained in the medium M, and a kind of medium M.

When there is a nozzle 42 that does not discharge the ink over a long period of time among the plurality of nozzles 42 disposed in the discharge portion 41, the discharge defect of the ink easily occurs in such a nozzle 42. In the case where there is the nozzle 42 that does not discharge the ink over the long period of time, the determination time ts may be shorter than that in the case where there is no nozzle 42 that does not discharge the ink over the long period of time. It should be noted that the long period of time mentioned herein is, for example, a period longer than the unit time to but shorter than the determination time ts.

The maintenance portion 70 may be one executing maintenance other than the cleaning.

For example, the maintenance portion 70 may include a wiper that wipes the nozzle surface on which the nozzle 42 of the discharge portion 41 is formed, in which the wiper may perform wiping that wipes the nozzle surface. When the wiping is performed, the wiper may relatively move with respect to the fixed discharge portion 41 and the discharge portion 41 may relatively move with respect to the fixed wiper.

In addition, the maintenance portion 70 may include a pressurization portion that pressurizes ink supplied to the common liquid chamber 411 and increases the pressure of the common liquid chamber 411 in order to perform pressurization cleaning in which the ink from the nozzle 42 communicating with the common liquid chamber 411 is discharged (leaked).

When a plurality of print jobs are input, it is preferable that suction cleaning be executed or the pressurization cleaning be executed, after execution of a print job ends and before execution of the next print job starts. In this case, it is possible to recover the nozzles 42 in which the discharge defects are going to occur even if they are not defective nozzles in a normal state, before the next print job is executed.

The determination of whether or not a nozzle becomes defective may be made by other methods. For example, a photographing portion (camera) that observes a flight aspect of the ink discharged from the nozzle 42 may be provided, and it may be determined whether or not a nozzle becomes defective on the basis of a photographing result of the photographing portion.

The ventilation portion 80 may not be provided. In this case, it is preferable to suppress the humidity in the housing 11 from rising by forming large opening areas of an introduction port through which the medium M is introduced into the housing 11 and a discharge port 13 through which the medium M is discharged outside the housing 11 large.

The humidity detection portion 83 may be disposed inside the housing 11. In this case, it is preferable that the humidity detection portion 83 be disposed in an area in which gas flows. Even in this case, it is possible to acquire an effect similar to the effect (6) of the above embodiment while being influenced by an environment inside the housing 11.

An approximate expression that calculates the nozzle ambient humidity Hn may be created by performing a multiple regression analysis using the nozzle discharge humidity Hn as a target variable and using variables such as the discharge amount of ink and the nozzle ambient temperature Tn as explanatory variables while collecting data by performing an experiment or a simulation in advance. In this way, even when each variable is changed, it is possible to easily calculate the nozzle ambient humidity Hn.

In step S17, the control device 100 may determine whether or not the print job can be executed based on the nozzle ambient humidity Hn represented by relative humidity and may determine whether or not the print job can be executed based on the nozzle ambient humidity Hn represented by absolute humidity.

When the nozzle ambient humidity Hn is assumed to be the absolute humidity, the nozzle ambient humidity Hn may be calculated by dividing the sum of a mass of solvent vapor evaporated from the ink discharged to the medium M and a mass of solvent vapor contained in the outside air taken into the housing 11 for ventilation by a mass of air in the housing 11. Alternatively, the nozzle ambient humidity Hn may be calculated by dividing the mass of the solvent vapor evaporated from the ink discharged to the medium M by a mass of air in the area between the discharge portion 41 supported by the carriage 43 moving in the width direction X and the second support portion 32.

The discharge portion 41 may be a long ink jet head that can discharge the ink over the width direction X of the medium M and is fixedly disposed inside the housing 11.

The solvent of the ink may not be water. For example, the solvent of the ink may be an organic solvent.

The medium M may be fiber, leather, plastic, wood, and ceramic, in addition to the paper.

The medium M may be a sheet-shaped medium M or a simply long medium M, in addition to the medium M unwound from the roll body 21.

The liquid discharged or ejected by the discharge portion 41 is not limited to the ink, but may be, for example, a liquid medium or the like in which particles of a functional material are dispersed in or mixed with a liquid. For example, recording may be performed by discharging the liquid medium containing materials such as electrode materials and color materials (pixel materials), which are used for manufacturing a liquid crystal display, an electroluminescence (EL) display, and a plane lighting display and the like, in a dispersion or dissolution form.

This application claims priority under 35 U.S.C. § 119 to Japanese Patent Application No. 2016-153407, filed Aug. 4, 2016. The entire disclosure of Japanese Patent Application No. 2016-153407 is hereby incorporated herein by reference.

What is claimed is:

1. A droplet discharge apparatus, comprising:

a discharge portion that has a nozzle discharging droplets to a medium; and a control device that allows the discharge portion to discharge the droplets depending on an execution of a droplet discharge job defining a mode for discharging the droplets to the medium, wherein before the droplet discharge job is executed, the control device calculates a discharge amount fluctuation, which is a fluctuation in a discharge amount of liquid per unit time by the discharge portion, based on the droplet discharge job, wherein when humidity in the vicinity of the nozzle is nozzle ambient humidity and the nozzle ambient humidity is used as a reference humidity serving as a threshold value that indicates whether drying of the nozzle is progressed, before the droplet discharge job is executed, the control device also calculates a humidity fluctuation which is a fluctuation in the nozzle ambient humidity per unit time based on the discharge amount fluctuation, and wherein the control device determines whether or not maintenance for recovering droplet discharge performance of the discharge portion is required at the time of executing the droplet discharge job based on the discharge amount fluctuation and based on when a state in which the nozzle ambient humidity per unit time is lower than the reference humidity continues in the humidity fluctuation.

2. The droplet discharge apparatus according to claim 1, wherein the control device calculates the humidity fluctuation based on a nozzle ambient temperature which is a temperature in the vicinity of the nozzle.

3. The droplet discharge apparatus according to claim 2, further comprising:

a temperature detection portion that detects the nozzle ambient temperature, wherein the control device acquires the nozzle ambient temperature based on a detection result of the temperature detection portion.

4. The droplet discharge apparatus according to claim 3, further comprising:

a heating portion that heats the medium to which the droplets are discharged, wherein the control device acquires the nozzle ambient temperature based on a driving mode of the heating portion.

5. The droplet discharge apparatus according to claim 1, further comprising:

a housing that houses the discharge portion; and a ventilation portion that ventilates an inside of the housing by taking outside air into the housing, wherein the control device calculates the humidity fluctuation based on outside air humidity which is humidity of the outside air.

6. The droplet discharge apparatus according to claim 5, wherein the ventilation portion includes a take-in channel that takes the outside air into the housing and a humidity detection portion that detects the outside air humidity, and the humidity detection portion is provided in the take-in channel.

7. A control device of a droplet discharge apparatus executing a droplet discharge job defining a mode for discharging droplets of a discharge portion to a medium, wherein before the droplet discharge job is executed, the control device calculates a discharge amount fluctuation, which is a fluctuation in a discharge amount of liquid per unit time by the discharge portion, based on the droplet discharge job, wherein when humidity in the vicinity of a nozzle is nozzle ambient humidity and the nozzle ambient humidity is used as a reference humidity serving as a threshold value that indicates whether drying of the nozzle is progressed, before the droplet discharge job is executed, the control device also calculates a humidity fluctuation which is a fluctuation in the nozzle ambient humidity per unit time based on the discharge amount fluctuation, and wherein the control device determines whether or not maintenance for recovering droplet discharge performance of the discharge portion is required at the time of executing the droplet discharge job based on the discharge amount fluctuation and based on when a state in which the nozzle ambient humidity per unit time is lower than the reference humidity continues in the humidity fluctuation.

8. A control method of a droplet discharge apparatus executing a droplet discharge job defining a mode for discharging droplets of a discharge portion to a medium, the control method comprising: before the droplet discharge job is executed, calculating a discharge amount fluctuation, which is a fluctuation in a discharge amount of liquid per unit time by the discharge portion, based on the droplet discharge job;

calculating, when humidity in the vicinity of a nozzle is nozzle ambient humidity and the nozzle ambient humidity is used as a reference humidity serving as a threshold value that indicates whether drying of the nozzle is progressed, a humidity fluctuation which is a fluctuation in the nozzle ambient humidity per unit time based on the discharge amount fluctuation; and determining whether or not maintenance for recovering droplet discharge performance of the discharge portion is required at the time of executing the droplet discharge job based on the discharge amount fluctuation and based on when a state in which the nozzle ambient humidity per unit time is lower than the reference humidity continues in the humidity fluctuation.

* * * * *